US008858735B2

(12) United States Patent
Kondo et al.

(10) Patent No.: US 8,858,735 B2
(45) Date of Patent: Oct. 14, 2014

(54) HIGH-STRENGTH PRESS HARDENED ARTICLE, AND MANUFACTURING METHOD THEREFOR

(75) Inventors: Masaaki Kondo, Nagoya (JP); Shinichi Suzuki, Tokyo (JP); Toshimasa Tomokiyo, Tokyo (JP); Koichi Nishizawa, Tokyo (JP); Takayuki Suzuki, Okazaki (JP); Yuki Ishiguro, Chiryu (JP); Hideyuki Kai, Nagoya (JP)

(73) Assignees: Toyota Jidosha Kabushiki Kaisha, Aichi-ken (JP); Nippon Steel & Sumitomo Metal Corporation, Tokyo (JP); Aisin Takaoka Co., Ltd., Aichi-ken (JP)

( * ) Notice: Subject to any disclaimer, the term of this patent is extended or adjusted under 35 U.S.C. 154(b) by 689 days.

(21) Appl. No.: 13/147,510

(22) PCT Filed: Feb. 1, 2010

(86) PCT No.: PCT/IB2010/000185

§ 371 (c)(1), (2), (4) Date: Aug. 2, 2011

(87) PCT Pub. No.: WO2010/089644

PCT Pub. Date: Aug. 12, 2010

(65) Prior Publication Data

US 2011/0303328 A1 Dec. 15, 2011

(30) Foreign Application Priority Data

Feb. 3, 2009 (JP) ..... 2009-022537

(51) Int. Cl.

| | |
|---|---|
| ***C22C 38/00*** | (2006.01) |
| ***C23C 2/28*** | (2006.01) |
| ***C21D 8/02*** | (2006.01) |
| ***C23C 2/06*** | (2006.01) |
| ***C21D 1/673*** | (2006.01) |

(52) U.S. Cl.

CPC ..... *C21D 8/0278* (2013.01); *C21D 2221/00* (2013.01); *C23C 2/28* (2013.01); *C23C 2/06* (2013.01); *C21D 1/673* (2013.01)

USPC ..... 148/320; 148/533

(58) Field of Classification Search

CPC .. C21D 1/673; C21D 8/0278; C21D 2221/00; C23C 2/06; C23C 2/28; C22C 38/04; C22C 38/18; C22C 38/32

USPC ..... 148/320, 533

See application file for complete search history.

(56) References Cited

U.S. PATENT DOCUMENTS

| | | | |
|---|---|---|---|
| 2003/0189027 | A1 | 10/2003 | Garcia Gomez |
| 2007/0000117 | A1 | 1/2007 | Brandstatter et al. |
| 2008/0075970 | A1 | 3/2008 | Suzuki et al. |

FOREIGN PATENT DOCUMENTS

| | | | |
|---|---|---|---|
| CN | 1502707 | A | 7/2003 |
| CN | 1985018 | A | 6/2007 |
| DE | 1 483 247 | A | 3/1969 |
| GB | 1057530 | A | 2/1967 |
| JP | 61-060821 | A | 3/1986 |
| JP | 2000-248338 | A | 9/2000 |
| JP | 2001-353548 | A | 12/2001 |
| JP | 2003-073774 | A | 3/2003 |
| JP | 2003-126920 | A | 5/2003 |
| JP | 2003-126921 | A | 5/2003 |
| JP | 2003-328031 | A | 11/2003 |
| JP | 2005-047001 | A | 2/2005 |
| JP | 2005-113233 | A | 4/2005 |
| JP | 2006-022395 | A | 1/2006 |
| JP | 2006-212690 | A | 8/2006 |
| JP | 2008-068282 | A | 3/2008 |

OTHER PUBLICATIONS

Suzuki et al., English machine translation of JP 2006-022395 from the IDS, Jan. 26, 2006, p. 1-12.*

Maikranz-Valentin M et al: "Components with optimised properties due to advanced thermo-mechanical process strategies in hot sheet metal forming", Steel Research International, Verlag Stahleisen GmbH, Dusseldorf, DE, vol. 79, No. 2, pp. 92-97, Sep. 18, 2007.

Japanese Office Action for corresponding JP Patent Application No. 2009-022537 drafted May 24, 2011.

International Search Report and Written Opinion for corresponding International Patent Application No. PCT/IB2010/000185 mailed Jul. 20, 2010.

* cited by examiner

*Primary Examiner* — Roy King
*Assistant Examiner* — Caitlin Kiechle
(74) *Attorney, Agent, or Firm* — Sughrue Mion, PLLC

(57) ABSTRACT

A high-strength quenched formed article has a zinc plating layer which is formed at a post-quenching formed steel sheet surface, and which contains 30 g/m$^2$ or more of a phase that contains 5% or more by mass but 30% or less by mass of Fe, and which also contains 0.15% or more by mass but less than 2% by mass of at least one of Al and Si in a separate fashion or a composite fashion, and contains Zn, which makes up substantially a rest portion of the zinc plating layer, and an inevitable impurity, wherein the high-strength quenched formed article has a high-strength portion having a post-quenching-formation tensile strength of 1000 MPa or more, and a low-strength portion having a post-quenching-formation tensile strength of 800 MPa or less.

6 Claims, 10 Drawing Sheets

FIG. 5

| STEEL SPECIES No. | C | Si | Mn | P | S | Al | Ti | Cr | Ni | Nb | Mo | V | Zr | B | N | Ac3 POINT (°C) |
|---|---|---|---|---|---|---|---|---|---|---|---|---|---|---|---|---|
| A | 0.20 | 0.15 | 1.30 | 0.02 | 0.005 | 0.035 | 0.023 | 0.3 | 0.1 | 0.01 | 0.1 | 0.05 | 0.01 | 20 ppm | 30 ppm | 825 |
| B | 0.22 | 0.15 | 2.00 | 0.01 | 0.005 | 0.04 | 0.025 | 0.25 | 0.002 | 0.05 | 0.05 | 0.05 | 0.02 | 15 ppm | 40 ppm | 795 |
| C | 0.11 | 0.20 | 3.00 | 0.02 | 0.005 | 0.05 | 0.03 | 0.5 | 0.2 | 0.005 | 0.005 | 0.01 | 0.02 | 20 ppm | 30 ppm | 803 |
| D | 0.31 | 0.15 | 3.50 | 0.02 | 0.005 | 0.05 | 0.02 | 0.5 | 0.8 | 0.05 | 0.05 | 0.05 | 0.01 | 20 ppm | 30 ppm | 741 |

% EXCEPT B, N

FIG. 6A

| No | ① | ④ | | | | ⑦ | | | ⑮ | | | | | | ㉑ | | | ㉕ | | |
|---|---|---|---|---|---|---|---|---|---|---|---|---|---|---|---|---|---|---|---|---|
| | | ② | ③ | ⑤ | ⑥ | ⑧ | ⑨ | ⑩ | ⑪ | ⑫ | ⑭ | | ⑱ | ⑲ | ⑳ | ㉒ | ㉓ | ㉔ | ㉖ | ㉗ |
| | | | | | | | | | | ⑬ | ⑯ | ⑰ | | | | | | | | |
| EXAMPLE 1 | A | 1.6 | MOLTEN ZINC | 45 | 45 | <1% | 0.22 | – | CONDUCTION HEATING | 845 | GAS (AIR) | 705 | 8 | 20% | GAS (AIR) | 8 | 720 | DIE COOLING | 50 | 150 |
| EXAMPLE 2 | A | 1.6 | MOLTEN ZINC | 45 | 45 | <1% | 0.22 | – | CONDUCTION HEATING | 847 | GAS (AIR) | 710 | 10 | 20% | GAS (AIR) | 12 | 700 | DIE COOLING | 50 | 80 |
| EXAMPLE 3 | A | 1.6 | MOLTEN ZINC | 45 | 45 | <1% | 0.22 | – | CONDUCTION HEATING | 844 | GAS (AIR) | 720 | 10 | 20% | GAS (AIR) | 15 | 680 | DIE COOLING | 50 | 70 |
| EXAMPLE 4 | A | 1.6 | MOLTEN ZINC | 45 | 45 | <1% | 0.22 | – | CONDUCTION HEATING | 845 | MIST | 520 | 15 | 20% | GAS (AIR) | 23 | 660 | DIE COOLING | 50 | 180 |
| EXAMPLE 5 | A | 1.6 | MOLTEN ZINC | 45 | 45 | <1% | 0.22 | – | CONDUCTION HEATING | 846 | MIST | 550 | 15 | 20% | GAS (AIR) | 42 | 540 | DIE COOLING | 50 | 80 |
| EXAMPLE 6 | A | 1.6 | MOLTEN ZINC | 60 | 60 | <1% | 0.22 | – | CONDUCTION HEATING | 852 | MIST | 510 | 20 | 20% | GAS (AIR) | 59 | 510 | DIE COOLING | 50 | 70 |
| EXAMPLE 7 | A | 1.6 | MOLTEN ZINC | 60 | 60 | <1% | 0.22 | – | CONDUCTION HEATING | 850 | GAS (AIR) | 720 | 20 | 20% | GAS (AIR) | 18 | 645 | DIE COOLING | 50 | 80 |
| EXAMPLE 8 | A | 1.6 | MOLTEN ZINC | 60 | 60 | <1% | 0.22 | – | CONDUCTION HEATING | 851 | GAS (AIR) | 660 | 20 | 20% | GAS (AIR) | 12 | 710 | DIE COOLING | 50 | 80 |
| COMPARATIVE EXAMPLE 1 | A | 1.6 | MOLTEN ZINC | 60 | 60 | <1% | 0.22 | – | CONDUCTION HEATING | 844 | GAS (AIR) | 650 | 20 | 20% | NONE | 12 | 750 | DIE COOLING | 50 | 80 |
| COMPARATIVE EXAMPLE 2 | A | 1.6 | MOLTEN ZINC | 60 | 60 | <1% | 0.22 | – | CONDUCTION HEATING | 850 | GAS (AIR) | 650 | 20 | 20% | NONE | 120 | 600 | DIE COOLING | 50 | 80 |
| COMPARATIVE EXAMPLE 3 | A | 1.6 | MOLTEN ZINC | 60 | 60 | <1% | 0.22 | – | CONDUCTION HEATING | 845 | GAS (AIR) | 650 | 20 | 20% | MIST | 30 | 410 | DIE COOLING | 50 | 80 |
| COMPARATIVE EXAMPLE 4 | A | 1.6 | MOLTEN ZINC | 60 | 60 | <1% | 0.22 | – | CONDUCTION HEATING | 770 | GAS (AIR) | 660 | 20 | 20% | GAS (AIR) | 10 | 700 | DIE COOLING | 50 | 80 |
| COMPARATIVE EXAMPLE 5 | A | 1.6 | MOLTEN ZINC | 60 | 60 | <1% | 0.22 | – | CONDUCTION HEATING | 848 | – | – | 20 | 20% | GAS (AIR) | 16 | 680 | DIE COOLING | 50 | 80 |
| COMPARATIVE EXAMPLE 6 | A | 1.6 | MOLTEN ZINC | 60 | 60 | <1% | 0.22 | – | CONDUCTION HEATING | 830 | MIST | 440 | 18 | 20% | GAS (AIR) | 20 | 670 | DIE COOLING | 50 | 80 |
| COMPARATIVE EXAMPLE 7 | A | 1.6 | MOLTEN ZINC | 60 | 60 | <1% | 0.22 | – | CONDUCTION HEATING | 1050 | MIST | 660 | 25 | 20% | GAS (AIR) | 30 | 690 | DIE COOLING | 50 | 80 |

FIG. 6B

| No | ① | ④ | | | | ⑦ | | | ⑮ | | | | | | ㉑ | | | ㉕ | | |
|---|---|---|---|---|---|---|---|---|---|---|---|---|---|---|---|---|---|---|---|---|
| | | ② | ③ | ⑤ | ⑥ | ⑧ | ⑨ | ⑩ | ⑪ | ⑫ | ⑭ | | ⑱ | ⑲ | ⑳ | ㉒ | ㉓ | ㉔ | ㉖ | ㉗ |
| | | | | | | | | | | ⑬ | ⑯ | ⑰ | | | | | | | | |
| EXAMPLE 9 | B | 2.0 | MOLTEN ZINC | 90 | 90 | <1% | 0.16 | – | CONDUCTION HEATING | 860 | GAS (AIR) | 720 | 25 | 20% | GAS (AIR) | 18 | 620 | DIE COOLING | 50 | 140 |
| EXAMPLE 10 | B | 2.0 | MOLTEN ZINC | 150 | 150 | <1% | 0.16 | – | CONDUCTION HEATING | 850 | GAS (AIR) | 700 | 25 | 20% | GAS (AIR) | 17 | 630 | DIE COOLING | 50 | 100 |
| COMPARATIVE EXAMPLE 8 | B | 2.0 | MOLTEN ZINC | 25 | 25 | <1% | 0.16 | – | CONDUCTION HEATING | 850 | GAS (AIR) | 710 | 25 | 20% | GAS (AIR) | 17 | 630 | DIE COOLING | 50 | 100 |
| COMPARATIVE EXAMPLE 9 | B | 2.0 | MOLTEN ZINC | 190 | 190 | <1% | 0.16 | – | CONDUCTION HEATING | 850 | GAS (AIR) | 710 | 25 | 20% | GAS (AIR) | 17 | 630 | DIE COOLING | 50 | 100 |
| EXAMPLE 11 | C | 2.3 | MOLTEN ZINC | 32 | 32 | <1% | 1.00 | – | CONDUCTION HEATING | 860 | MIST | 600 | 29 | 20% | MIST | 11 | 590 | DIE COOLING | 50 | 60 |
| EXAMPLE 12 | C | 2.3 | MOLTEN ZINC | 60 | 59 | <1% | 1.00 | 0.1 | CONDUCTION HEATING | 860 | MIST | 600 | 29 | 20% | MIST | 11 | 590 | DIE COOLING | 50 | 60 |
| EXAMPLE 13 | C | 2.3 | MOLTEN ZINC | 60 | 59 | <1% | 1.00 | 0.2 | CONDUCTION HEATING | 860 | MIST | 600 | 29 | 20% | MIST | 11 | 590 | DIE COOLING | 50 | 60 |
| EXAMPLE 14 | C | 2.3 | MOLTEN ZINC | 60 | 59 | <1% | 2.00 | | CONDUCTION HEATING | 860 | MIST | 600 | 29 | 20% | MIST | 11 | 590 | DIE COOLING | 50 | 60 |
| COMPARATIVE EXAMPLE 10 | C | 2.3 | MOLTEN ZINC | 90 | 86 | <1% | 5.00 | | CONDUCTION HEATING | 860 | MIST | 600 | 29 | 20% | MIST | 11 | 590 | DIE COOLING | 50 | 60 |
| COMPARATIVE EXAMPLE 11 | C | 2.3 | ELECTRO-ZINC | 60 | 60 | <1% | 0.00 | | CONDUCTION HEATING | 860 | MIST | 600 | 29 | 20% | MIST | 11 | 590 | DIE COOLING | 50 | 60 |
| COMPARATIVE EXAMPLE 12 | C | 2.3 | ALLOYING MOLTEN ZINC | 62 | 56 | 9 | 0.10 | | CONDUCTION HEATING | 860 | MIST | 600 | 29 | 20% | MIST | 11 | 590 | DIE COOLING | 50 | 60 |
| EXAMPLE 15 | D | 1.0 | MOLTEN ZINC | 40 | 40 | <1% | 0.18 | | CONDUCTION HEATING | 800 | GAS (AIR) | 610 | 5 | 20% | GAS (AIR) | 15 | 690 | DIE COOLING | 50 | 80 |
| EXAMPLE 16 | D | 1.0 | MOLTEN ZINC | 40 | 40 | <1% | 0.18 | | LAMP HEATING | 800 | LIGHT BLOCKING | 670 | 40 | 20% | GAS (AIR) | 15 | 690 | DIE COOLING | 50 | 80 |
| EXAMPLE 17 | D | 1.0 | MOLTEN ZINC | 40 | 40 | <1% | 0.18 | | LAMP HEATING | 800 | LIGHT BLOCKING | 670 | 40 | 1% | GAS (AIR) | 15 | 690 | DIE COOLING | 50 | 80 |

FIG. 6C

| No | ① | ④ | | | | ⑦ | | | ⑮ | | | | | | ㉑ | | | ㉕ | | |
|---|---|---|---|---|---|---|---|---|---|---|---|---|---|---|---|---|---|---|---|---|
| | | ② | ③ | ⑤ | ⑥ | ⑧ | ⑨ | ⑩ | ⑪ | ⑫ | ⑭ | | ⑱ | ⑲ | ⑳ | ㉒ | ㉓ | ㉔ | ㉖ | ㉗ |
| | | | | | | | | | | ⑬ | ⑯ | ⑰ | | | | | | | | |
| EXAMPLE 18 | D | 1.0 | MOLTEN ZINC | 40 | 40 | <1% | 0.18 | | LAMP HEATING | 800 | LIGHT BLOCKING+ GAS (AIR) | 530 | 40 | 20% | GAS (AIR) | 15 | 690 | DIE COOLING | 50 | 80 |
| COMPARATIVE EXAMPLE 13 | D | 1.0 | MOLTEN ZINC | 40 | 40 | <1% | 0.18 | | LAMP HEATING | 800 | LIGHT BLOCKING | 670 | 40 | 0.1ppm | GAS (AIR) | 15 | 690 | DIE COOLING | 50 | 80 |
| EXAMPLE 19 | D | 1.0 | MOLTEN ZINC | 60 | 60 | <1% | 0.22 | – | CONDUCTION HEATING | 845 | GAS (AIR) | 660 | 20 | 20% | GAS (AIR) | 12 | 710 | DIE COOLING | 30 | 150 |
| COMPARATIVE EXAMPLE 14 | A | 1.6 | MOLTEN ZINC | 60 | 60 | <1% | 0.22 | – | CONDUCTION HEATING | 843 | GAS (AIR) | 660 | 20 | 20% | GAS (AIR) | 12 | 710 | DIE COOLING | 10 | 150 |
| EXAMPLE 20 | A | 1.6 | MOLTEN ZINC | 60 | 60 | <1% | 0.22 | – | CONDUCTION HEATING | 844 | GAS (AIR) | 660 | 20 | 20% | GAS (AIR) | 12 | 710 | DIE COOLING | 100 | 15 |
| COMPARATIVE EXAMPLE 15 | A | 1.6 | MOLTEN ZINC | 60 | 60 | <1% | 0.22 | – | – | – | – | – | – | – | – | – | – | – | – | – |
| COMPARATIVE EXAMPLE 16 | A | 1.6 | MOLTEN ZINC | 45 | 45 | <1% | 0.22 | – | CONDUCTION HEATING | 845 | GAS (AIR) | 720 | 600 | 20% | GAS (AIR) | 15 | 510 | DIE COOLING | 50 | 80 |

1:STEEL SPECIES
2:SHEET THICKNESS mm
3:PLATING METHOD
4:BEFORE HEATING
5:PLATING AMOUNT $g/m_2$
6:INTERNAL Zn AMOUNT $g/m_2$
7:COMPOSITION (%)
8:Fe%
9:Al
10:Si
11:HEATING METHOD
12:QUENCHED PORTION
13:ATTAINED TEMPERATURE ℃
14:PARTIALLY COOLED PORTION (UNQUENCHED PORTION)
15:HEATING CONDITION
16:COOLING METHOD
17:ATTAINED TEMPERATURE ℃
18:TIME SEC
19:ATMOSPHERE OXYGEN CONCENTRATION
20:COOLING METHOD
21:PRE-PROCESSING COOLING
22:COOLING TIME SEC
23:PROCESSING START TEMPERATURE ℃
24:COOLING METHOD
25:PROCESSING QUENCHING
26:COOLING RATE ℃/SEC
27:ENDING TEMPERATURE ℃

FIG. 7A

| No | ① | | | ⑥ | | | ⑪ | ⑫ | | ⑮ | ⑯ | ⑰ |
|---|---|---|---|---|---|---|---|---|---|---|---|---|
| | ② | | | ⑦ | | | | ⑬ | ⑭ | | | |
| | ③ | ④ | ⑤ | ⑧ | ⑨ | ⑩ | | | | | | |
| EXAMPLE 1 | 49 | 36 | 26 | 48 | 39 | 18 | 1 | 1670 | 760 | NONE | 6000< | OK |
| EXAMPLE 2 | 48 | 36 | 26 | 48 | 38 | 20 | 1 | 1650 | 770 | NONE | 6000< | OK |
| EXAMPLE 3 | 50 | 37 | 26 | 49 | 39 | 21 | 1 | 1630 | 770 | NONE | 6000< | OK |
| EXAMPLE 4 | 48 | 36 | 26 | 47 | 43 | 8 | 1 | 1610 | 760 | NONE | 6000< | OK |
| EXAMPLE 5 | 48 | 36 | 26 | 49 | 44 | 10 | 1 | 1540 | 770 | NONE | 6000< | OK |
| EXAMPLE 6 | 65 | 48 | 26 | 63 | 59 | 6 | 1 | 1420 | 760 | NONE | 6000< | OK |
| EXAMPLE 7 | 68 | 50 | 26 | 70 | 57 | 19 | 1 | 1650 | 760 | NONE | 6000< | OK |
| EXAMPLE 8 | 66 | 49 | 26 | 68 | 58 | 15 | 1 | 1600 | 770 | NONE | 6000< | OK |
| COMPARATIVE EXAMPLE 1 | 67 | 50 | 26 | 68 | 58 | 15 | 1 | 1660 | 770 | INTERGRANULAR FRACTURE | 6000< | OK |
| COMPARATIVE EXAMPLE 2 | 61 | 45 | 26 | 61 | 51 | 17 | 1 | 780 | 760 | NONE | 6000< | OK |
| COMPARATIVE EXAMPLE 3 | 66 | 49 | 26 | 67 | 58 | 14 | – | – | – | PROCESSING RUPTURE | – | – |
| COMPARATIVE EXAMPLE 4 | 67 | 50 | 26 | 66 | 56 | 15 | 1 | 770 | 770 | NONE | 6000< | OK |
| COMPARATIVE EXAMPLE 5 | 66 | 49 | 26 | – | – | – | 1 | 1610 | 1600 | NONE | 2500 | NG |
| COMPARATIVE EXAMPLE 6 | 65 | 48 | 26 | 60 | 59 | 2 | 1 | 1610 | 770 | NONE | 500 | OK |
| COMPARATIVE EXAMPLE 7 | 15 | 11 | 26 | 61 | 51 | 17 | 18 | 1640 | 770 | NONE | 6000< | OK |
| EXAMPLE 9 | 92 | 70 | 24 | 92 | 82 | 11 | 1 | 1470 | 750 | NONE | 6000< | OK |
| EXAMPLE 10 | 155 | 116 | 25 | 159 | 148 | 7 | 1 | 1490 | 730 | NONE | 6000< | OK |
| COMPARATIVE EXAMPLE 8 | 22 | 17 | 25 | 22 | 18 | 18 | 20 | 1480 | 740 | NONE | 6000< | OK |
| COMPARATIVE EXAMPLE 9 | 205 | 158 | 23 | 193 | 187 | 3 | 1 | 1490 | 740 | NONE | 300 | OK |
| COMPARATIVE EXAMPLE 11 | 40 | 29 | 27 | 35 | 31 | 11 | 1 | 1085 | 580 | NONE | 6000< | OK |
| COMPARATIVE EXAMPLE 12 | 77 | 58 | 25 | 65 | 59 | 9 | 1 | 1080 | 580 | NONE | 6000< | OK |

FIG. 7B

| No | ① | | | ⑥ | | | ⑪ | ⑫ | | ⑮ | ⑯ | ⑰ |
|---|---|---|---|---|---|---|---|---|---|---|---|---|
| | ② | | | ⑦ | | | | ⑬ | ⑭ | | | |
| | ③ | ④ | ⑤ | ⑧ | ⑨ | ⑩ | | | | | | |
| EXAMPLE 13 | 78 | 59 | 25 | 64 | 60 | 7 | 1 | 1090 | 560 | NONE | 6000< | OK |
| EXAMPLE 14 | 79 | 59 | 25 | 63 | 59 | 6 | 1 | 1080 | 570 | NONE | 6000< | OK |
| COMPARATIVE EXAMPLE 10 | 108 | 82 | 22 | 92 | 86 | 2 | 1 | 1080 | 570 | NONE | 1000 | OK |
| COMPARATIVE EXAMPLE 11 | 0 | 0 | 0 | 0 | 0 | 0 | 55 | 1085 | 580 | NONE | 6000< | OK |
| COMPARATIVE EXAMPLE 12 | 0 | 0 | 0 | 12 | 9 | 27 | 45 | 1080 | 560 | NONE | 6000< | OK |
| EXAMPLE 15 | 49 | 37 | 24 | 45 | 41 | 9 | 1 | 1980 | 780 | NONE | 6000< | OK |
| EXAMPLE 16 | 44 | 33 | 26 | 43 | 38 | 12 | 1 | 1980 | 780 | NONE | 6000< | OK |
| EXAMPLE 17 | 43 | 32 | 26 | 43 | 38 | 12 | 1 | 1970 | 780 | NONE | 6000< | OK |
| EXAMPLE 18 | 44 | 33 | 26 | 43 | 38 | 12 | 1 | 1980 | 770 | NONE | 6000< | OK |
| COMPARATIVE EXAMPLE 13 | 21 | 16 | 26 | 21 | 16 | 24 | 13 | 1980 | 780 | NONE | 6000< | OK |
| EXAMPLE 19 | 66 | 49 | 26 | 63 | 56 | 11 | 1 | 1580 | 750 | NONE | 6000< | OK |
| COMPARATIVE EXAMPLE 14 | 65 | 48 | 26 | 62 | 55 | 11 | 1 | 760 | 740 | NONE | 6000< | OK |
| EXAMPLE 20 | 66 | 49 | 26 | 64 | 57 | 11 | 1 | 1690 | 770 | NONE | 6000< | OK |
| COMPARATIVE EXAMPLE 15 | 60 | 60 | <0.1 | 60 | 60 | <0.1 | 1 | 750 | 750 | NONE | 500 | OK |
| COMPARATIVE EXAMPLE 16 | 3 | 2 | 26 | 5 | 4 | 27 | 33 | 1670 | 760 | NONE | 6000< | OK |

1:QUENCHED PORTION
2:Zn-Fe ALLOY PHASE CONTAINING Fe<30%
3:ALLOY PHASE AMOUNT $g/m_2$
4:INTERNAL (Zn AMOUNT) $g/m_2$
5:Fe%
6:UNQUENCHED PORTION (COOLED PORTION)
7:Zn-Fe ALLOY PHASE CONTAINING Fe<30%
8:ALLOY PHASE AMOUNT $g/m_2$
9:INTERNAL (Zn AMOUNT) $g/m_2$
10:Fe%
11:CORROSION RESISTANCE SWELL WIDTH mm
12:STRENGTH
13:QUENCHED PORTION MPa
14:UNQUENCHED PORTION MPa
15:BASE MATERIAL CRACKING
16:WELDABILITY NUMBER OF TIMES OF WELDING
17:PUNCHING CHARACTERISTIC

HIGH-STRENGTH PRESS HARDENED ARTICLE, AND MANUFACTURING METHOD THEREFOR

FIELD OF THE INVENTION

The invention relates to a formed article having been subjected to a quenching process for the purpose of increasing the strength, which is excellent in processability and also excellent in corrosion resistance and fatigue resistance, and also relates to a manufacturing method for the formed article.

BACKGROUND OF THE INVENTION

In recent years, the strength increase of automotive component parts and materials for use in automotive component parts is being pursued for the purpose of weight reduction of motor vehicles, and improvement in safety. With regard to steel sheet, which is a representative one of such materials, the rate of use of high-strength steel sheets is increasing. However, the high-strength steel sheet, generally, is high in strength, and hard, and therefore offers only a small degree of freedom in the forming in terms of press formability, and also is poor in the shape fixability of the pressed product (formed article), giving rise to problems of no-good dimensional accuracy, short service life of press dies, etc. While betterment of these problems is being pursued by improving materials, a technology generally called hot-work pressing, hot pressing or hot stamping is increasingly employed for the purpose of obtaining component parts with further increased strength and with good shape accuracy. Specifically, the technology is a hot process in which a steel sheet is soften by heating it to or above 800° C. (Ac3 point), and is rapidly cooled simultaneously with the press forming so as to obtain a very-high-strength component part. Besides, a cold processing-quenching technology in which the cold processing is followed by a quenching process as mentioned above so as to provide a high-strength component part has also come to be used as an industrial technology.

Industrial machines represented by motor vehicles need to have sufficient corrosion resistance in the environments of use. Therefore, component parts obtained by forming in a cold process a zinc or zinc alloy-plated steel sheet that is excellent in cost and corrosion resistance are sometimes used in such industrial machines.

Japanese Patent Application Publication No. 2001-353548 (JP-A-2001-353548) discloses a manufacturing method for a high-strength formed component part which secures the protection against corrosion and decarbonization, and lubrication performance by obtaining a zinc or zinc alloy layer of 5 μm to 30 μm by heating and cooling. Japanese Patent Application Publication No. 2003-73774 (JP-A-2003-73774) discloses a steel sheet for hot pressing which has a barrier layer for preventing evaporation of zinc during heating. Japanese Patent Application Publication No. 2003-126920 (JP-A-2003-126920) discloses a hot-pressing method for a zinc or zinc alloy plated steel sheet. Japanese Patent Application Publication No. 2003-126921 (JP-A-2003-126921) discloses a hot-pressed formed item that has an iron-zinc solid solution layer.

However, although these methods are better in corrosion resistance than quenched formed items of iron without plating, but not as sufficient in corrosion resistance as formed items of a plated steel sheet formed in an ordinary cold process. A cause of this corrosion resistance degradation has been estimated, as a result of studies by the present inventors, to be that Zn valatilizes, reducing the amount of plating (plating weight), and further more, the plating layer has an Fe—Zn alloy phase that is made up mainly of Fe that is solid-dissolved in Zn, so that the rust expansion of corrosion becomes large, and therefore accelerates the corrosion. Apart from the problem of plated steel sheets formed by the foregoing hot processing, aluminum plated steel sheets are employed for uses that require as high corrosion resistance as in the case of ordinary plated steel sheets. However, in the case where the aluminum plated steel sheet is used, the corrosion resistance after quenching becomes lower than that of cold-formed items made of a plated material.

Besides, Japanese Patent Application Publication No. 2000-248338 (JP-A-2000-248338) discloses a method in which a zinc or zinc alloy plated steel sheet, after being processed, is partially hardened by heating necessary portions at high frequency and then rapidly cooling the heated portions. However, since the heating after the processing causes strain, the shape of the component parts cannot be maintained, and therefore the method is not practical. Japanese Patent Application Publication No. 2006-022395 (JP-A-2006-022395) discloses a high-strength formed article excellent in corrosion resistance in which a phase made up of 30% or less by mass of Fe is contained in an amount of 30 g/m$^2$ or more, and a manufacturing method for the high-strength formed article. However, since this method makes the entire formed article high in strength, there is a possibility of the processability and operability declining after the high strength is obtained. For example, as for the processing, the boring process becomes difficult to perform, and it is possible that a finishing process for preventing cracks can be needed. Besides, as for the operation, since the entire formed article, including its flanges, has high hardness, the spot welding in an assembly process of a motor vehicle fails due to undesired contact of a welding electrode, resulting in a problem of good welding quality being impossible to secure, or the like.

In view of the forgoing problems, there is a strong demand for a technology that makes it possible that a high-strength formed article that is good in processability and operability can be formed by a zinc or zinc alloy-plated quenched material that is superior in terms of corrosion resistance and cost.

SUMMARY OF THE INVENTION

The invention provides a high-strength quenched formed article being excellent in processability and corrosion resistance which is formed in a manner in which a high-strength formed article excellent in processability and operability is formed from a zinc or zinc alloy plated steel sheet that is superior in terms of cost by mainly quenching portions of high strength while avoiding quenching the sites that require later processing or operation or the like, so that the corrosion resistance of the post-quenching formed item is equal to or higher than the corrosion resistance of a counterpart item that is formed by a cold process, and also provides a manufacturing method for the high-strength quenched formed article.

The inventors of this application have made vigorous studies and investigations about the cause of a phenomenon that the zinc or zinc alloy-plated steel sheet after being subjected to hot pressing, including quenching, is inferior in corrosion resistance to an ordinary zinc-plated steel sheet, for example, an alloyed molten zinc-plated steel sheet. As a result, the inventors have reached a conclusion that the cause of the degradation of the corrosion resistance is that the plating layer acquires an Fe—Zn alloy phase made up mainly of Fe solid-dissolved in Zn as well as the volatilization of Zn causing a reduction in the amount of plating. That is, the ordinary zinc-plated steel sheet exhibits corrosion resistance due to the effect of a closely packed-Zn protective layer formed when Zn is oxidized at the time of corrosion, rather than the effect of sacrificial protection against corrosion. However, a zinc-plated steel sheet that is hot-processed at a temperature equal or higher than the Ac3 point does not exhibit corrosion resistance even though the hot-processed zinc-plated steel sheet has a considerably larger amount of the Fe—Zn alloy phase as a Zn content in the steel surface than the ordinary zinc-plated steel sheet. The inventors have considered that since the Fe—Zn alloy phase produced by quenching is normally made up mainly of Fe, the volume expansion of Fe resulting from oxidation of Fe at the time of corrosion does not allow the formation of a closely packed film of zinc oxide. Therefore, the inventors, on the basis of a concept that, in order to realize corrosion resistance, it is important that a good-quality Zn—Fe alloy phase made up mainly of Zn exists sufficiently in terms of quantity, invented a "high-strength quenched formed article excellent in corrosion resistance being characterized by containing, in a post-quenching formed steel sheet surface, 30 g/m$^2$ or more of a phase that contains Zn as a main component, and that contains 30% or less by mass of Fe". Furthermore, the inventors also found that, in order to achieve both good quenching strength and good corrosion resistance, conditions regarding the heating temperature, the rapid cooling rate, etc. are important, and that in order to restrain the intergranular fracture in the base material during the quenching forming (hot stamping), it is necessary to rapidly perform the quenching in a predetermined condition immediately prior to the hot-stamping process. However, it has been found that the formed article of the invention has problems, such as an insufficient range of proper spot welding, while being excellent in strength and corrosion resistance.

Hence, through studies and investigations for improvements in operability, such as the spot weldability and the like, besides good strength and good corrosion resistance, the inventors have found that the operability can be made better by reducing the strength of the sheet of spot-welded portions to or below 800 MPa for improved compatibility between the sheet and the spot-welding electrode tip, and by forming a plating layer of a Zn alloy that contains 5% or more by mass of Fe so that the plating layer has an increased melting point, and then have accomplished simultaneous achievement of good strength and good corrosion resistance in a single formed article as mentioned above.

A first aspect of the invention relates to a high-strength quenched formed article. This high-strength quenched formed article has, at a post-quenching formed steel sheet surface, a zinc plating layer which contains 30 g/m$^2$ or more of a phase that contains 5% or more by mass but 30% or less by mass of Fe, and which also contains 0.15% or more by mass but less than 2% by mass of at least one of Al and Si in a separate fashion or a composite fashion, and contains Zn, which makes up substantially a rest portion of the zinc plating layer, and an inevitable impurity, and the high-strength quenched formed article has a high-strength portion having a post-quenching-formation (post-hot stamping) tensile strength of 1000 MPa or more, and a low-strength portion having a post-quenching-formation tensile strength of 800 MPa or less.

The steel sheet may contain 0.1% or more by mass of C, 0.5% or more by mass of Mn, 0.1.% or more by mass of Cr, and 0.0005% or more by mass of B.

The steel sheet may contain Ti, Nb, Mo, V, Zr, W, Co, Cu and Ni each in a range of 1% or less by mass.

A second aspect of the invention is a manufacturing method for a high-strength quenched formed article. This high-strength quenched formed article has, at a post-quenching formed steel sheet surface, a zinc plating layer which contains 30 g/m$^2$ or more of a phase that contains 5% or more by mass but 30% or less by mass of Fe, and which also contains 0.15% or more by mass but less than 2% by mass of at least one of Al and Si in a separate fashion or a composite fashion, and contains Zn, which makes up substantially a rest portion of the zinc plating layer, and an inevitable impurity, and the high-strength quenched formed article has a high-strength portion having a post-quenching-formation (post-hot stamping) tensile strength of 1000 MPa or more, and a low-strength portion having a post-quenching-formation tensile strength of 800 MPa or less. The manufacturing method of this aspect of the invention includes: making a zinc-plated steel sheet that includes a zinc plating layer that has 0.15% or more by mass but less than 2% by mass of at least one of Al and Si in a separate fashion or a composite fashion in a manner that a portion of the zinc-plated steel sheet that is to be heated at a temperature that is higher than or equal to an Ac3 point but lower than or equal to 950° C. in an oxidative atmosphere that contains 0.1% or more by volume of oxygen, and a portion of the zinc-plated steel sheet that is to be heated at a temperature that is higher than or equal to 500° C. but lower than the Ac3 point are simultaneously made; then starting to cool the zinc-plated steel sheet, and within 60 seconds, cooling the zinc-plated steel sheet to a temperature range that is equal to or less than 730° C. and higher than or equal to 500° C.; and then pressing the zinc-plated steel sheet within the temperature range, and then rapidly cooling the zinc-plated steel sheet.

The Ac3 point may be higher than or equal to 700° C. and lower than or equal to 880° C.

The rapid cooling may be performed so that temperature reaches 200° C. or lower at a rate of 30° C./sec or faster.

According to the high-strength quenched formed article and the manufacturing method for the high-strength quenched formed article according to the foregoing aspects of the invention, it is possible to obtain a high-strength quenched formed article excellent in corrosion resistance and processability which achieves corrosion resistance and processability of the post-quenching formed item that are equal to or higher than the corrosion resistance and the processability of a counterpart item that is formed by a cold process. That is, in order that a post-quenching formed component part will be a high-strength component part that is at least equal in corrosion resistance and usability to a cold-formed zinc or zinc alloy-plated steel material, the high-strength quenched formed article and the manufacturing method for the same according to the invention are contrived in both the property of the zinc plating layer of the quenched steel material and the method of quenching, unlike the existing quenching methods. Therefore, the dimensional accuracy of high-strength component parts can be drastically improved, and it becomes possible to promote weight reduction, safety improvement, improvement in rust resistance, and improvement in operability in industrial machines at advantageous costs.

BRIEF DESCRIPTION OF THE DRAWINGS

The foregoing and further features and advantages of the invention will become apparent from the following description of preferred embodiments with reference to the accompanying drawings, wherein like numerals are used to represent like elements and wherein:

FIG. 5 is a table showing steel components of a hot-rolled steel sheet and of a cold-rolled steel sheet; and FIGS. 6A to 6C and FIGS. 7A and 7B are tables showing zinc or zinc alloy plating constructions and their performances.

DETAILED DESCRIPTION OF THE EMBODIMENTS

Figure 1:
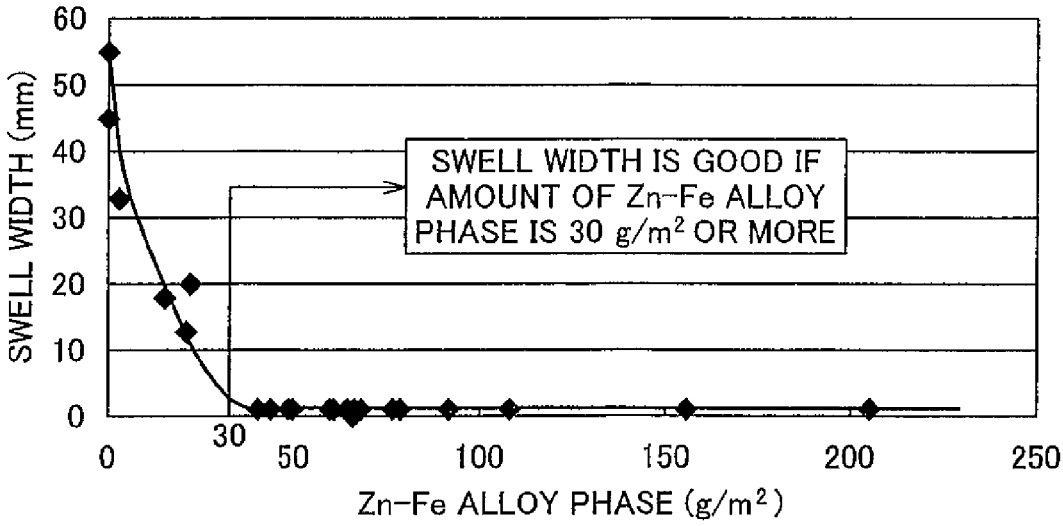
FIG. 1 is a diagram showing a relation between the amount of a Zn—Fe alloy phase and the swell width as an evaluation of the corrosion resistance.

Hereinafter, embodiments of the invention will be described in detail. Firstly, a formed article of an embodiment will be described. The formed article of this embodiment needs to have, at a post-quenching formed steel sheet surface, a zinc plating layer which contains 30 g/m$^2$ or more of a Zn—Fe alloy phase that contains 5% or more by mass but 30% or less by mass of Fe, and which contains 0.15% or more by mass but 2% or less by mass of at least one of Al and Si in a separate fashion or a composite fashion; and which also contains Zn, which makes up substantially a rest portion of the zinc plating layer, and an inevitable impurity. FIG. 1 shows a relation between the amount of the Zn—Fe alloy phase and the swell width as an evaluation of corrosion resistance. The evaluation of the corrosion resistance was carried out as follows. That is, after the degreasing was performed and the chemical conversion treatment was carried out through the use of PALBOND LA35 (by Nihon Parkerizing Co., Ltd.) exactly according to the maker's prescription, cation electrodeposition coating (POWERNICS 110 by NIPPON PAINT Co., Ltd.) was performed to 15 μm, and then the crosscutting was performed. After that, the corrosion resistance was evaluated in terms of the swell width measured after 300 cycles of the test under the SAE-J2334 corrosion test conditions according to the standards of Society of Automotive Engineers.

It can be understood from FIG. 1 that if the Zn—Fe alloy phase that contains 5% or more by mass but 30% or less by mass of Fe is present in an amount that greater than or equal to 30 g/m$^2$, the swell width becomes less than or equal to 1 mm, and the corrosion resistance becomes good. On the other hand, if the plating layer is made up of a Zn—Fe alloy phase that contains 30% or less by mass of Fe but the amount of the Zn—Fe alloy phase is less than 30 g/m$^2$, the alloy phase is small in amount and the corrosion resistance is insufficient, so that the swell width becomes large, that is, the corrosion resistance deteriorates. Furthermore, if the amount of Fe in the alloy phase is less than 5% by mass, or is greater than 30% by mass, the swell width undesirably increases and the corrosion resistance degrades. This is considered to be because if the amount of Fe is greater than 30% by mass, the plating layer generated by the heating at the time of quenching obtains an alloy layer made up mainly of Fe, so that at the time of corrosion, Fe rust is formed, bringing about volume expansion, and thus sufficient corrosion resistance cannot be obtained. If the amount of Fe is less than 5% by mass, the swell width is good, but the melting point of the plating layer is low so that at the time of spot welding, melt occurs between the sheets, bringing about an increased area of electrification or electricity conduction, which decreases the current density and therefore decreases the spot weldability.

Incidentally, the upper limit of the amount of the Zn—Fe alloy phase that contains 30% or less by mass of Fe is not particularly limited. However, taking into consideration the amount of zinc plating itself, the high-temperature duration in the hot stamping, the powdering at the time of press processing, etc., a feasible upper limit is 150 g/m$^2$. Besides, the Fe—Zn alloy phase containing greater than 30% by mass of Fe as a main component which is generated by heating is not particularly restricted.

Besides, in order that the amount of the Zn—Fe alloy phase containing 30% or less by mass of Fe will be greater than or equal to 30 g/m$^2$ so as to achieve a corrosion resistance that is at least equal to that of ordinary plating, it is effective that one or two species of metals selected from the group consisting of Al and Si are contained in an amount of 0.15% or more by mass, as alloy-retarding elements that have an alloy-retarding function and an easy oxidation function. If one or both of these elements are present in a total amount of 0.15% or more by mass in the zinc plating before heating, even the heating at or above 800° C., which is higher than or equal to the Ac3 point, will drastically restrain the diffusion of Zn into the base iron, so that the amount of the Zn—Fe alloy phase containing 30% or less by mass of Fe can be made greater than or equal to 30 g/m$^2$. Conversely, if the total amount of one or both of the foregoing elements is less than 0.15% by mass, the diffusion of Zn into the base iron is so fast that the Zn—Fe alloy containing Zn as a main component and 30% or less by mass of Fe almost entirely disappears before the temperature of the steel sheet reaches the Ac3 point (800° C.) and thus corrosion resistance cannot be achieved. Incidentally, if the total amount thereof is greater than 2% by mass, the restraint of the diffusion becomes excessive, so that, in the portion not to be quenched, that is, in the portion that is heated at or above 500° C. and below the Ac3 point and therefore has a strength of 800 MPa or less, the amount of Fe in the Zn—Fe alloy phase becomes less than 5%, and therefore it becomes difficult to secure weldability.

It suffices that the strength of the portion to be quenched is at least a strength that is needed, for example, 1000 MPa or more from the standpoint of the strength of the structure, the safety at the time of collision, etc., although the concrete value thereof varies according to the purpose. As for the portions that do not need to have high strength, and that are subjected to spot welding or a punching process, a strength thereof equal to or less than 800 MPa will remarkably improve operability. Incidentally, using this method, for example, for motor vehicle component parts or the like, it is possible to provide a portion that is intended to crush by providing a high-strength portion and a low-strength portion in a single component part.

Incidentally, after the quenching process, the oxide coating film on the surface of the plating layer may be removed through the use of an alkaline solution or an acidic solution for the purpose of improving the paint adhesion characteristic and the chemical conversion treatment characteristic, as long as the Zn—Fe alloy phase containing 5% or more by mass but 30% or less by mass of Fe is present in an amount of 30 g/m$^2$ or more. Besides, as long as the Zn—Fe alloy phase is made up mainly of Zn, and contains 5% or more by mass but 30% or less by mass of Fe, one or more elements, such as Ni, Co, Mn, P, B, etc., may also be contained in the zinc plating layer, for the purpose of further improving the corrosion resistance, and improving the chemical conversion treatment characteristic. Besides, the zinc-plated steel sheet for use for the formed article of the embodiment is a zinc-plated steel sheet that is cut out in a sheet shape, and may also be a so-called tailored blank steel sheet that is obtained by joining a plurality of zinc-plated steel sheets into one sheet by welding. This improves the degree of freedom of the formed article, and is therefore preferable.

Next, a manufacturing method for the formed article in accordance with the embodiment will be described. In the manufacturing method of this embodiment, a zinc-plated steel sheet that includes a zinc plating layer that has, in a steel sheet surface that has a quenching characteristic, 0.15% or more by mass but less than 2% by mass of at least one of Al and Si, which have an alloy-retarding function, and an easy oxidation function, in a separate fashion or a composite fashion is used as a base material, and a portion of the zinc-plated steel sheet that is to be heated at a temperature that is higher than or equal to an Ac3 point but lower than or equal to 950° C. in an oxidative atmosphere that contains 0.1% or more by volume of oxygen, and a portion of the zinc-plated steel sheet that is to be heated at a temperature that is 500° C. or higher but lower than the Ac3 point are simultaneously provided, and are each heated for an appropriately adjusted heating time; then cooling of the zinc-plated steel sheet is started, and within 60 seconds after the cooling is started, the zinc-plated steel sheet is cooled to a temperature range that is equal to or less than 730° C. and higher than or equal to 500° C.; and then the zinc-plated steel sheet is press-processed, rapidly cooled within the foregoing temperature range (equal to or less than 730° C. and higher than or equal to 500° C.).

Incidentally, any steel sheet may be used in the embodiment as long as it is an ordinary quenched steel sheet. However, it is preferable that the steel sheet contain 0.10% or more of C, 0.5% or more of Mn, 0.1% or more of Cr, and 0.0005% more of B, which are expressed in percent by mass, and further contain Fe, which makes up substantially the rest portion of the steel sheet, and Al and N as inevitable impurities. Incidentally, it is also permissible that the steel sheet may contain Ti, Nb, Mo, V, Zr, W, Co, Cu, or Ni in the range of 1% or less by mass, in order to selectively improve the strength and control the crystal grains, prevent fracture, and add corrosion resistance.

As for the Ac3 point of the steel material, it suffices that the heating is carried out while the heating and the cooling are performed across the Ac3 point temperature as long as the Ac3 point of the steel material is higher than 500° C., which is above the temperature that is needed for the alloying of the zinc plating, and lower than 900° C., which is lower than the boiling point of zinc. Incidentally, as the feasible industrial level, it is desirable that a design be made such that the Ac3 point is higher than or equal to 700° C. and lower than or equal to 880° C. If the Ac3 point is above 880° C., it is difficult to control the temperature in the range higher than 880° C. and lower than 900° C., which is lower than or equal to the boiling point of zinc, taking into consideration variations in the temperature of the whole steel sheet during the quenching heating process. If the Ac3 point is lower than 700° C., it becomes necessary to use large amounts of quenching elements, leading to a cost increase. Incidentally, as for how to find the Ac3 point, the Ac3 point can be found by measuring changes in the thermal expansion amount while the steel sheet is being heated. Specifically, as the temperature rises, the steel sheet expands. When the temperature exceeds the Ac1 point, and the transformation to austenite occurs, the steel sheet shrinks as the temperature rises to the Ac3 point. A point of inflection of the thermal expansion curve is the Ac3 point. As for the measurement equipment, for example, ZAMEC MASTER (by Fuji Electronic Industrial Co., Ltd.) or the like may be used for the measurement.

Normally, during the hot processing at or above the Ac3 point (a temperature of about 800° C. or higher in the foregoing steel sheet component system), Zn evaporates into the heating furnace due to sufficient vapor pressure. Since Al and Si as easily oxidizable elements are contained in a separate or composite fashion in an amount of 0.15% or more by mass in the Zn plating, and since an oxidative atmosphere in which at last 0.1% by volume of oxygen is present is formed in the furnace, the easily oxidizable elements in the coasting surface restrains Zn in the zinc plating from diffusing into the base iron, and also is continuously oxidized to form a closely packed oxide coating film along with expansions due to heat. Therefore, it becomes possible to restrain the evaporation of Zn even in the heating temperature range equal to or higher than the Ac3 point (800° C.) and lower than or equal to 950° C. Conversely, if the foregoing easily oxidizable elements are present in an amount less than 0.15% by mass or the atmosphere within the furnace is a neutral-to-reductive atmosphere in which oxygen is present in an amount less than 0.1% by volume, a closely packed coating film of easily oxidizable elements cannot be sufficiently formed on the zinc surface, and Zn evaporates and the amount of Zn for preventing rust decreases. Besides, for the portion of the steel sheet that needs to obtain high strength, the heating temperature is set at or above the Ac3 point (800° C.) in order to allow the quenching for obtaining the high-strength steel sheet. However, if the heating temperature is higher than 950° C., the oxide film formed by the easily oxidizable elements cannot restrain the evaporation of Zn caused by boiling. Therefore, the highest heating temperature is set at 950° C. Using the foregoing means, the evaporation of Zn can be effectively restrained even in the highest-temperature heating portion.

It suffices that the heating duration is set at a time that is required until the entire steel sheet reaches a temperature that is needed for the quenching. Besides, in the case where the heating duration becomes long because of the thickness of the steel sheet, the capability of the heating device, and the handling device, it is possible to increase the amount of the alloy-retarding elements per unit area in the plating (increase the concentration of these elements in the plating or increase the amount of plating) in order to reduce the heating duration. However, since the low-strength portion also needs to be alloyed as mentioned above, it is necessary to adjust the amount of the foregoing elements while taking into consideration that the amount thereof needs to be less than or equal to 2% by mass so that the alloying can be accomplished at a temperature that is higher than or equal to 500° C. and lower than the Ac3 point.

As for the portions of the steel sheet that need to be good in weldability and processability, it is necessary that the hardness or strength be less than or equal to 800 MPa and the quenching not occur, in order to maintain the softness. To this end, it suffices that the heating temperature for the portion concerned is lower than the Ac3 point. Furthermore, by heating that portion to or above 500° C., the zinc plating can be alloyed so as to achieve a content of Fe that is 5% or more by mass, so that the melting point of the plating layer is raised. Therefore, while the compatibility between the steel sheet and the welding electrodes at the time of spot welding is bettered, the spreading of melt of the plating between the sheets can be restrained, and therefore the area of electricity conduction can be reduced to maintain high density of current. Therefore, the spot weldability can be considerably bettered.

The method of heating the steel sheet may be internal heating, such as electric conduction heating or induction heating, or may also be external heating, such as lamp heating, gas heating, or electric furnace heating, or may also be a combination of any two or more of the foregoing heating methods in order to reduce the heating duration. However, since the portion that is heated at or above 500° C. and below the Ac3 point is partially cooled or shielded from heat, it is preferable to use the internal heating method by electric conduction heating or induction heating, or the radiation heating method by lamp heating in terms of heat efficiency, operability, and controllability.

Figure 2A:
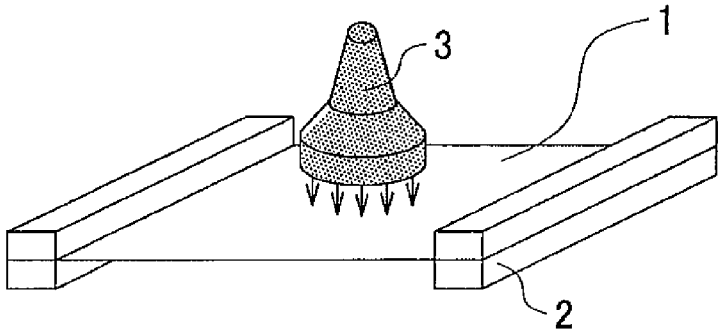
FIGS. 2A to 2C are diagrams showing an example of the manufacture of a high-strength quenched formed article that has both a high-strength portion and a low-strength portion.
Figure 2B:
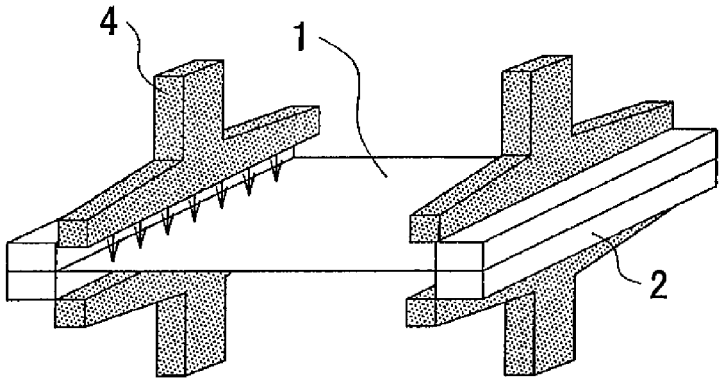
Figure 2C:
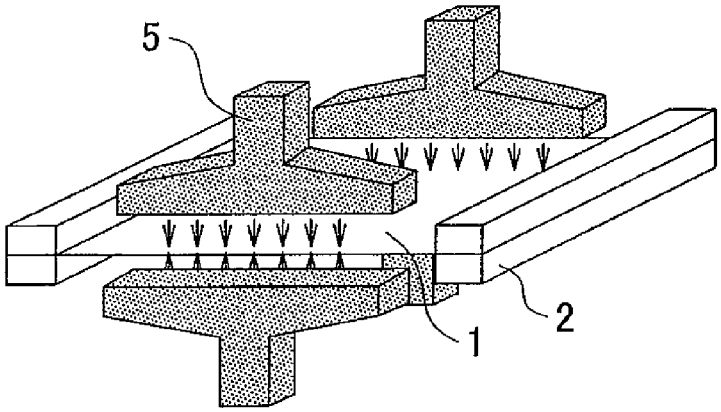

For the portion where quenching is not brought about, that is, the portion whose temperature is curbed within the range higher than or equal to 500° C. and lower than the Ac3 point, it is possible to employ a method of compulsorily spraying a cooling medium, such as air or mist, to a portion that needs to be cooled, or a method of cooling the portion of the steel sheet through extraction of heat or the like that is achieved through the contact with a cooling plate in which a water-cooled cooling pipe is disposed. Besides, in the case of the radiation heating by lamp heating, the heating can be blocked or avoided by a shield of a heat insulation material or the like. Incidentally, the heat insulation material is preferably a ceramic material or the like that does not react with the plating metal. For example, in the case where a steel sheet 1 is subjected to electric conduction heating through the use of electrodes 2 as shown in FIGS. 2A to 2C, the cooling is accomplished by disposing a cooling box 3 that sprays a cooling fluid (e.g., air) at a predetermined position on the steel sheet 1 that is to be hot-stamped, for example, at a position at which a boring process is performed after the hot stamping, and then cooling an adjacent portion of the steel sheet 1 through the use of the cooling box 3. Besides, considering the welding after the processing of a motor vehicle component part, it is also preferable that cooling boxes 4 be disposed near or along the electrodes 2 as shown in FIG. 2B, or that, as shown in FIG. 2C, cooling boxes 5 be disposed two opposite ends of the steel sheet 1 that extend between the electrodes 2, and perform cooling. Furthermore, the manners of cooling shown in FIG. 2A to C may be arbitrarily combined. Incidentally, many nozzle holes (e.g., which have a diameter of about 1 m, and a nozzle pitches of about 5 mm) are provided as an example of the structure of the bottom surface of each of the cooling boxes 3 to 5, and the cooling medium is sprayed from the nozzles to cool the adjacent portions.

It suffices that the amount of Zn plating on an original steel sheet is greater than or equal to 30 g/m$^2$, depending on the targeted corrosion resistance. Preferably, it suffices that the amount of Zn plating is greater than or equal to 40 g/m$^2$, taking into consideration the time of handling the heating furnace, the fluctuations of temperature. On the other hand, considering that in the portion that is to be heated to or above 500° C. and below the Ac3 point, the alloying is promoted to achieve 5% or more by mass of Fe, it is preferable that the amount of Zn plating be less than or equal to 180 g/m$^2$. The zinc-plated steel sheet is preferably a steel sheet that is made by the molten zinc plating method as is apparent from the foregoing principle. A alloyed molten zinc-plated steel sheet in which is the alloying performed beforehand is unpreferable since the alloyed molten zinc-plated steel sheet causes undesired depletion of alloy-retarding elements, and thus reduces the alloy-retarding effect. Besides, an electro-zinc plating method is unpreferable since the method requires a pre-process for the addition of alloy-retarding elements, and therefore requires high cost.

Next, in order to restrain the intergranular fracture of the base material at the time hot-stamp processing by sufficiently solidifying the zinc plating layer, the cooling is performed after the zinc-plated steel sheet is taken out of the furnace, that is, a heating equipment. Within 60 seconds following the start of cooling, the steel sheet is cooled to a temperature that is lower than or equal to 730° C. and higher than or equal to 500° C. The pre-cooling prior to the processing is carried out in order to achieve both quenching and prevention of the intergranular fracture of the base material due to invasion of molten zinc. Therefore, the temperature of the portion that is not quenched may be a temperature that allows the pressing process and that is lower than or equal to the melting point, that is, may be lower than 500° C. The crack that takes place in the processing above 730° C. occurs on the tensile side of the base material. According to studies by the present inventors, it has been found that a cause of the crack is the invasion of molten zinc into the old austenite grain boundary of the base material. Therefore, the cooling to or below 730° C. sufficiently solidifies the zinc alloy of the plating, and therefore eliminates the invasion of molten zinc, thus preventing the fracture of a surface of the base material at the time of hot-stamp processing. Incidentally, suitable means for this operation is gas cooling or steam-water cooling. Besides, it suffices that the cooling equipment is provided between the heating equipment and the hot-stamping equipment. As one mode, the cooling equipment may be provided in a cooling zone. It is also permissible to adopt a method in which the cooling equipment is added to an equipment for conveyance from the heating equipment to the hot-stamping equipment, and the cooling is performed along with the conveyance.

Thus, the quenched portion is subjected to the cooling for the purpose of solidifying the zinc before the processing is started. For the sake of the quenching process, it is preferable that the quenched portion be in the austenite state when the cooling is performed. Therefore, the temperature of the base material before the quenched portion is processed is preferably higher than or equal to 500° C. If the base material temperature is lower than 500° C., martensite is produced and the formability deteriorates. Besides, the cooling duration is preferably within 60 seconds. If the cooling is performed slower than this, ferrite is produced and the quenched portion becomes soft, and does not obtain an intended high strength.

After that, the hot-stamping process is performed at the hot-stamping equipment that performs processing and rapid cooling, whereby the steel sheet is processed into a desired shape. For the sake of securement of the shape and good quenching, it is preferable that the base material be processed and rapidly cooled to or below 200° C. at a rate of 30° C./sec or higher. This makes it possible to manufacture a high-strength and high-corrosion resistant formed article being good in processability which has 30 g/m$^2$ or more of a plating layer that contains 70% or more by mass of Zn. It suffices that the cooling is performed at a cooling rate that achieves quenching, and it is permissible to use any cooling method, such as water cooling, gas cooling, contact cooling that uses a metal piece or the like, etc.

Next, examples of the invention will be shown together with comparative examples. FIG. 5 shows steel components of a hot-rolled steel sheet and a cold-rolled steel sheet that were manufactured by an ordinary manufacturing method. FIG. 6 and FIG. 7 show examples and comparative examples with regard to their zinc or zinc alloy plating constructions and performances. Since the addition of easily oxidizable elements to the plating layer is difficult by the electroplating method, easily oxidizable elements were separately added to a bath of molten zinc, and an ordinary molten Zn plating method was employed for the manufacture. As for the heat process, the steel sheets were heated to a temperature that is higher than or equal to the Ac3 point but lower than or equal to 950° C., by using the electric conduction heating, high-frequency induction heating, or lamp heating in the atmospheric atmosphere, and the heating to a temperature that is higher than or equal to 500° C. but lower than the Ac3 point was accomplished by performing partial cooling through air blowing or light blocking. After being taken out of the heating furnace, the steel sheets were appropriately cooled in air, and then were subjected to die cooling. The heating and cooling conditions are shown in FIG. 6.

Figure 3:
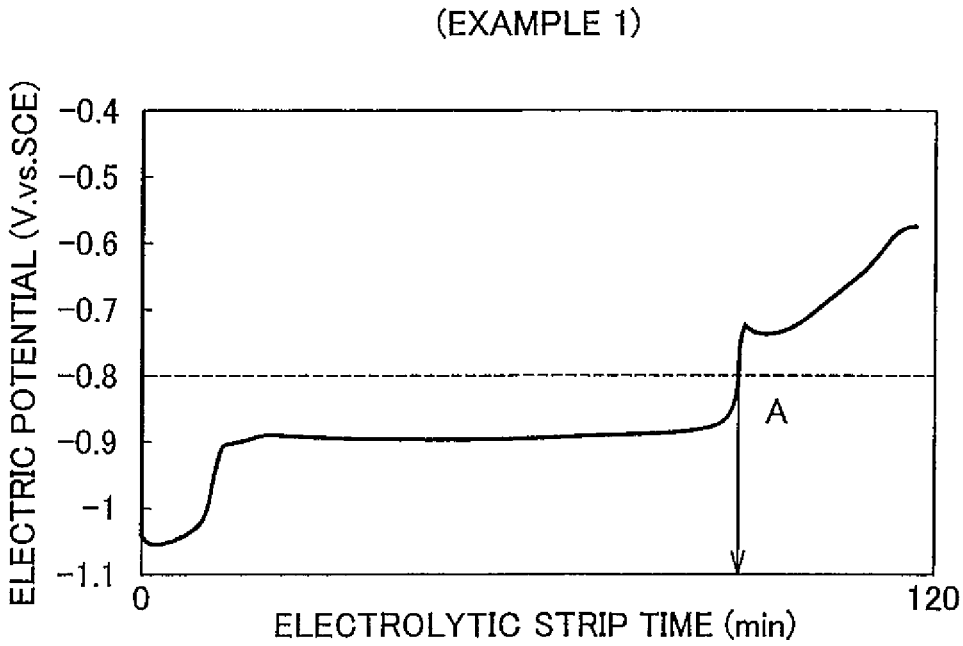
FIG. 3 is an illustrative diagram showing an electrolytic stripping curve in Example 1.

A phase containing Zn as a main component, and 5% or more by mass but 30% or less by mass of Fe was made as follows. Materials made from materials shown in FIG. 5 by performing the foregoing method with different heating temperatures and different heating durations were electrolyzed to a Γ phase of a point at which the electric potential greatly decreases to or below −80 mV.vs.SCE (to a region A in an example chart of constant-current electrolysis of the embodiment shown in FIG. 3), by a constant-current electrolysis method, at 4 mA/cm$^2$, through the use of a saturated calomel electrode as a reference electrode, in a 150 g/l-$NH_4Cl$ aqueous solution. Then, the electrolytic solution was subjected to measurement by ICP to find the amounts and proportions of Fe and Zn as amounts of plating that achieve the rust-resistant effect. That is, the invention was carried out as shown in FIG. 6. Incidentally, FIG. 7 shows plating compositions of high-strength steel sheet portions (quenched portions) that were quenched by heating to a temperature that is higher than or equal to the Ac3 point but lower than or equal to 950° C., and non-quenched portions obtained by heating to a temperature of 500° C. or higher but lower than the Ac3 point.

The strengths of the steel sheets were evaluated by a tensile test as follows. That is, JIS No. 5 tensile test pieces of the high-strength portions (quenched portions) that were quenched by heating to a temperature that is higher than or equal to the Ac3 point but lower than or equal to 950° C., and the non-quenched portions that are heated to a temperature that is higher than or equal to 500° C. but lower than the Ac3 point were made, and subjected to the test for evaluation. The high-strength portions having a strength of 1000 MPa or more, and the low-strength portions having a strength of 800 MPa or less are evaluated as being good. Results of the evaluation are shown in FIG. 7.

Figure 4:
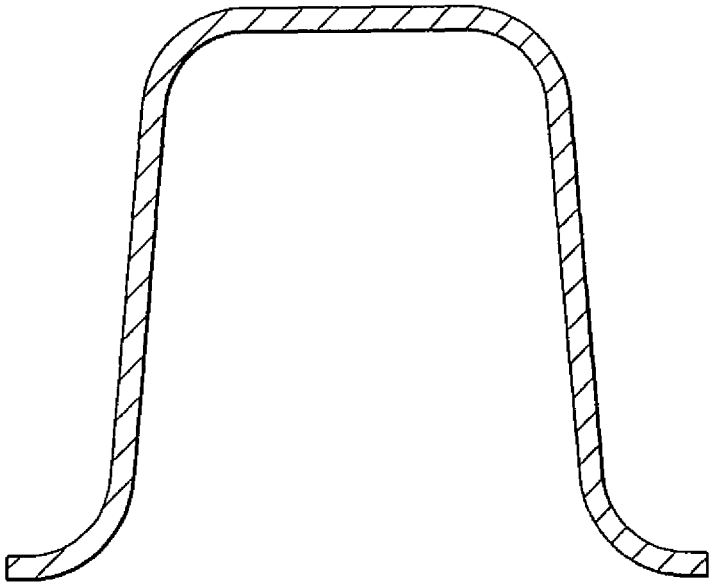
FIG. 4 is a diagram showing a sectional shape of a processing test piece.

The presence/absence of fracture (fracture of the base material) was investigated as follows. That is, test pieces having a sectional shape as shown in FIG. 4 were made by hot stamping, that is, press-processing, and cooling, and then sections of bent portions of the test pieces were observed for the presence/absence of fracture. Results of the investigation are shown in FIG. 7.

The corrosion resistance was investigated by measuring the foregoing swell width. Results of the measurement are shown in FIG. 7.

The spot-weldability was evaluated by evaluating changes in the diameter of nuggets that were formed by consecutively spot-welding non-quenched portions. Results of the evaluation are shown in FIG. 7. For the welding, a stationary spot welder was used, and the following settings were made: 3.4 kN of pressurizing force; 0.3 second of electrification time; and 0.08 second of hold time. The value of electric current was set for each steel species such that the nugget diameter on each steel species became 1.5 times $4\sqrt{t}$ (t is sheet thickness (mm)). Changes in the nugget diameter were found by measuring the nugget diameter by the peal test after the welding of every 250 points. The nugget diameter was obtained as a mean value of the diameters obtained in three rounds of the test. The number of times of welding at which the nugget diameter became smaller than $4\sqrt{t}$ was considered as the electrode service life, and the evaluation was performed up to a maximum of 6000 points of welding.

The punching characteristic was evaluated as follows. That is, non-quenched portions were punched by using a punching die having a punch diameter of 20 mm (with a clearance of 15%), and the punching load was measured. The punching characteristic was evaluated as being good (OK) when the punching load was less than or equal to the sheet thickness (mm)×40 kN, and was evaluated as being no good (NG) when the sheet thickness was greater than that. Results of the evaluation are shown in FIG. 7.

Comparative Example 1 is an example in which the preprocessing cooling was not sufficiently performed. In this comparative example, intergranular fracture of the base material occurred at the time of processing. In Comparative Example 2, the cooling prior to the processing took an excessive amount of time, so that quenching was not realized and the strength deteriorated. In Comparative Example 3, the cooling prior to the processing reached 500° C. or lower, so that rupture occurred at the time processing. In Comparative Example 4, the heating temperature was low, so that a necessary strength was not achieved. In Comparative Example 5, the partial cooling was not performed, so that the processed or welded portions were also quenched and therefore hardened, resulting in deterioration of weldability and process ability. In Comparative Example 6, the heating temperature of the partially cooled portions was as low as less than 500° C., so that the alloying of the plating does not sufficiently occur, and therefore the weldability was not bettered, but as poor as the weldability of the non-heated material of Comparative Example 15. Incidentally, the exceeding of the upper-limit temperature of the partially cooled portions is in substantially the same condition as the quenched portions, and therefore the test thereof was omitted.

In Comparative Example 7, the heating temperature was excessively high beyond the boiling point of zinc, zinc evaporated, and was excessively alloyed so that the alloy phase containing less than 30% by mass of Fe becomes small in quantity, and therefore the corrosion resistance deteriorated. In Comparative Example 8, the original amount of plating was small, so that the amount of the alloy phase containing less than 30% by mass of Fe became less than 30 g/m$^2$, and therefore the corrosion resistance was insufficient. In Comparative Example 9, the original amount of plating was excessively large, so that the plating composition of the unquenched portion had 5% by mass of Fe, and therefore the weldability betterment effect was insufficient.

In Comparative Example 10, the amount of plating alloying-restraining elements was large, and therefore the alloying of the partially cooled portion was slow, so that the plating composition of the unquenched portion had 5% by mass of Fe, and therefore the weldability betterment effect was insufficient. In Comparative Examples 11 and 12, the amount of plating alloying-restraining elements was null or small, so that zinc volatilized, and the alloying was excessively fast. In Comparative Example 16, the heating was performed for a long time, so that excessive alloying resulted. Therefore, in Comparative Examples 11, 12 and 16, the amount of the alloy phase containing less than 30% by mass of Fe was less than 30 g/m$^2$, and therefore the corrosion resistance was insufficient. In Comparative Example 13, the oxidizing property of the heating atmosphere was insufficient, and therefore zinc volatilized, so that the amount of the alloy phase containing less than 30% by mass of Fe was less than 30 g/m$^2$, and thus the corrosion resistance was insufficient. In Comparative Example 14, the cooling rate during the processing was slow, so that the strength deteriorated.

As described above, the foregoing comparative examples outside the scope of the invention were inferior in strength, corrosion resistance, fatigue resistance, weldability, and processability. On the other hand, in Examples 1 to 20 within the scope of the invention, the phase containing Zn as a main component and 5% or more by mass but 30% or less by mass of Fe was present in an amount of 30 g/m$^2$ or more, and high-strength portions having a strength of 1000 MPa or more were provided as main portions, and the rest was constituted by low-strength portions having a strength of 800 MPa or less. Thus, using a zinc or zinc alloy plated steel sheet that is superior in terms of cost, it is possible to provide a high-strength quenched formed article excellent in corrosion resistance, fatigue resistance, weldability, and processability such that the corrosion resistance of the post-quenching formed item is equal to or higher than the corrosion resistance of a counterpart item formed by a cold process.

While the invention has been described with reference to example embodiments thereof, it is to be understood that the invention is not limited to the described embodiments or constructions. To the contrary, the invention is intended to cover various modifications and equivalent arrangements. In addition, while the various elements of the disclosed invention are shown in various example combinations and configurations, other combinations and configurations, including more, less or only a single element, are also within the scope of the appended claims.

The invention claimed is:

1. A high-strength quenched formed article comprising a zinc plating layer which is formed at a post-quenching formed steel sheet surface, and which contains 30 g/m$^2$ or more of a phase that contains 5% or more by mass but 30% or less by mass of Fe, and which also contains 0.15% or more by mass but less than 2% by mass of at least one of Al and Si in a separate fashion or a composite fashion, and contains Zn, which makes up substantially a rest portion of the zinc plating layer, and an inevitable impurity, wherein the high-strength quenched formed article has a high-strength portion having a post-quenching-formation tensile strength of 1000 MPa or more, and a low-strength portion having a post-quenching-formation tensile strength of 800 MPa or less.

2. The high-strength quenched formed article according to claim 1, wherein the steel sheet contains 0.1% or more by mass of C, 0.5% or more by mass of Mn, 0.1% or more by mass of Cr, and 0.0005% or more by mass of B.

3. The high-strength quenched formed article according to claim 1, wherein the steel sheet contains Ti, Nb, Mo, V, Zr, W, Co, Cu and Ni each in a range of 1% or less by mass.

4. A manufacturing method for a high-strength quenched formed article that has, at a post-quenching formed steel sheet surface, a zinc plating layer which contains 30 g/m$^2$ or more of a phase that contains 5% or more by mass but 30% or less by mass of Fe, and which also contains 0.15% or more by mass but less than 2% by mass of at least one of Al and Si in a separate fashion or a composite fashion, and contains Zn, which makes up substantially a rest portion of the zinc plating layer, and an inevitable impurity, wherein the high-strength quenched formed article has a high-strength portion having a post-quenching-formation tensile strength of 1000 MPa or more, and a low-strength portion having a post-quenching-formation tensile strength of 800 MPa or less, the method comprising:

making a zinc-plated steel sheet that includes a zinc plating layer that has 0.15% or more by mass but less than 2% by mass of at least one of Al and Si in a separate fashion or a composite fashion in a manner that a portion of the zinc-plated steel sheet that is to be heated at a temperature that is higher than or equal to an Ac3 point but lower than or equal to 950° C. in an oxidative atmosphere that contains 0.1% or more by volume of oxygen, and a portion of the zinc-plated steel sheet that is to be heated at a temperature that is higher than or equal to 500° C. but lower than the Ac3 point are simultaneously made; then starting to cool the zinc-plated steel sheet, and, within 60 seconds, cooling the zinc-plated steel sheet to a temperature range that is equal to or less than 730° C. and higher than or equal to 500° C.; and then pressing the zinc-plated steel sheet within the temperature range, and then rapidly cooling the zinc-plated steel sheet.

5. The manufacturing method according to claim 4, wherein the Ac3 point is higher than or equal to 700° C. and lower than or equal to 880° C.

6. The manufacturing method according to claim 4, wherein the rapid cooling is performed so that temperature reaches 200° C. or lower at a rate of 30° C./sec or faster.

* * * * *